US005954060A

United States Patent [19]

Cardarelli

[11] Patent Number: 5,954,060

[45] Date of Patent: Sep. 21, 1999

[54] COAXIAL FILTER CIGARETTE

[76] Inventor: Venanzio Cardarelli, 20 N. Triangle Dr., Plymouth, Mass. 02360

[21] Appl. No.: 09/170,237

[22] Filed: Oct. 13, 1998

Related U.S. Application Data

[60] Provisional application No. 60/074,529, Feb. 12, 1998.

[51] Int. Cl.[6] ..... A24D 3/04; A24B 1/00

[52] U.S. Cl. ..... 131/360; 131/336; 131/338

[58] Field of Search ..... 131/360, 336, 131/335, 338

[56] References Cited

U.S. PATENT DOCUMENTS

| | | | |
|---|---|---|---|
| 3,860,011 | 1/1975 | Norman | 131/336 |
| 3,905,377 | 9/1975 | Yatrides | 131/336 |
| 4,022,222 | 5/1977 | Berger | 131/338 |
| 4,580,584 | 4/1986 | Reynolds et al. | 131/336 |
| 4,942,887 | 7/1990 | Abdelgawad et al. | 131/336 |
| 4,972,856 | 11/1990 | Sergio . | |
| 4,984,588 | 1/1991 | Stewart, Jr. | 131/364 |
| 5,115,823 | 5/1992 | Keritsis | 131/336 |
| 5,439,011 | 8/1995 | Schneider . | |
| 5,690,127 | 11/1997 | Chapman et al. | 131/364 |

*Primary Examiner*—Stanley S. Silverman
*Assistant Examiner*—Jacqueline A. Ruller
*Attorney, Agent, or Firm*—D. Michael Burns

[57] ABSTRACT

A cigarette having a filter rod which extends longitudinlly and coaxially through the cigarette cord of tobacco. A plurality of filter tags and rings are disposed through the tobacco cord, the quantity of each varied to strengthen or weaken the level of filtration. The filter rod having a concentric air passage channel longitudinally deposed along its length to increase the supply of fresh air available to the smoker.

11 Claims, 1 Drawing Sheet

COAXIAL FILTER CIGARETTE

CROSS REFERENCE TO RELATED APPLICATION

This application is based on Provisional Patent Application Serial No. 60/074,529, filed Feb. 12, 1998.

BACKGROUND OF THE INVENTION

1. Field of the Invention

The present invention relates to a cigarette with coaxial filtration. More specifically, a cigarette with filtration over the entire length of consumption of the cigarette cord.

2. Description of the Prior Art

It is known to provide cigarettes with filtration and aeration means. Aeration features are required to admit certain quantities of diluting streams of air for the purpose of effecting a concomitant reduction in the delivery of particulate matter in the smoke stream. This particulate matter is commonly called "tar" and also produces nicotine and carbon monoxide, all of which are injurious to the health of the smoker. Nicotine is a tertiary amine composed of pyridine and pyrrolidine rings. The nicotine in the tobacco smoke is absorbed mainly by inhalation. The nicotine is distilled from the burning tobacco and is carried proximally on tar droplets that are inhaled and deposited in the small airways and alveoli. It is imperative that these tar droplets be absorbed or adsorbed by a filtering medium before it reaches the mouth of the smoker. In addition to all the health problems generally associated with cigarettes, another risk caused by nicotine is the high incidence of periodontal disease. This is caused by nicotine penetrating the mucosal barrier in saliva and in the gingival crevicular fluid. Increasing the supply of fresh air will reduce the concentration of undesirable smoke constituents. It is part of the prior art for smoking devices to allow ventilation through its porous paper wrapping. The main problem with this method is that with most cigarettes, the tar delivered to the smoker increases puff by puff as the cigarette is consumed. However, as the cigarette becomes shorter, the dilution of the smoke stream by air is reduced because less of the porous paper wrapping it is available to provide dilution. It is highly desirable to increase the supply of air as the cigarette burns down. It is also very important to include filtration in conjunction with aeration techniques. It is the filter that is primarily responsible for the removal of the larger tar type products in the smoke stream. The prior art has numerous examples of filters and filtering processes whereby particulate matter to the smoker is reduced. Standard cigarettes usually place the filtration materials only at the mouth end of the cigarette. Whereas the prior art proposes numerous solutions, in most cases they have not been implemented due to cost considerations.

U.S. Pat. No. 5,439,011 issued to Schneider on Aug. 8, 1995 teaches the use of a coaxial filter, whereby a rod concentrically disposed within the filter aids in increasing the aeration. Again the prior art teaches a filter used at the mouth end of a cigarette. The present invention acknowledges the usefulness of a filter located at the mouth end, however it also teaches the practicality and efficiency of placing a filtering medium throughout the entire length of the cigarette.

U.S. Pat. No. 4,972,856, which issued to Sergio on Nov. 27, 1990, discloses a cigarette filter which is pushed into the tobacco cord of the cigarette. Sergio teaches a filter that is reusable and one that is not part of the cigarette and is thereby not installed by the manufacturer. The patented device of Sergio is used primarily as a final barrier, and located at the the mouth end. The present invention meanwhile teaches the use of filtration that extends the entire length of the cigarette and also which is combustible, frangible and easily friable. This will allow the filtering material to be easily knocked off with the accompanying ash of the tobacco.

None of the above inventions and patents, taken singly or in combination, is seen to describe the instant invention as claimed.

SUMMARY OF THE INVENTION

The coaxial filter cigarette of the present invention comprises a filter rod which is concentrically and longitudinally disposed within the cord of tobacco to provide additional filtering means. The rod extends the entire length of the cigarette cord and is very porous, enabling a secondary stream of air to intermingle with the tobacco. The filter rod allows for filtration during the entire consumption of the cigarette. The filtration of the device is enhanced by one or more tags which are uniformly spaced throughout the cigarette and are made of a filter material that is denser than the filter material found in the rod. The device uses a coaxial air passageway located within the rod and therefore the device does not depend entirely on the porosity of the filter in the rod to aerate the tobacco. Another embodiment uses one or more high density ring filters dispersed along the filter rod and between the tags to provide an optimum level of filtration. The number of rings and tags are a function of individual taste and selection.

Accordingly, it is a principal object of the invention to provide an effective method for simultaneously increasing the flow of fresh air, which obtains a more complete combustion of the tobacco, and also providing for a filtration means at every phase of the cigarette consumption.

It is another object of the invention to introduce a system whereby the taste is affected by the particulate matter present in the smoke stream. The user can select the amount of filtration he/she is willing to tolerate and thereby control the taste. The manufacturer will make this possible by stating on the package, the number of tags and filters present and at what level of strength they are at. Thereby the user can selectively choose the level of filtration desired and also the responsibility for his/her health.

It is still the main objective of the invention, that it be a system designed to reduce the incidence of disease, as well as hopefully weaning people off the smoking of cigarettes in a progressive manner and at a risk level they so choose. The manufacturer will make available the present invention as a healthy alternative to conventional cigarettes It is an object of the invention to have a cigarette which is inexpensive and easy to manufacture, one that will be fully effective in accomplishing its intended purpose.

It is another object of the invention to have a cigarette which will be esthetically pleasing for the user while being smoked. The various filtering elements in the tobacco cord all will be combustible, frangible and friable so that they will drop off with the ash as the cigarete burns down.

These and other objects of the present invention will become readily apparent upon further review of the following specification and drawings.

DETAILED DESCRIPTION OF THE PREFERRED EMBODIMENT

Figure 1:
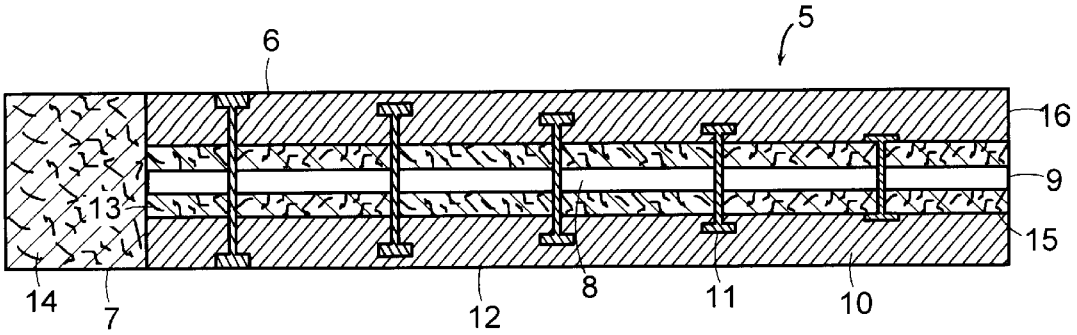
FIG. 1 is a longitudinal, cross-sectional view of the cigarette with tags.
Figure 2:
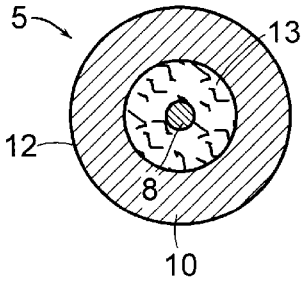
FIG. 2 is an end view of the cigarette as shown in FIG. 1.

The present invention relates generally to the removal of quantities of total particulate matter delivered during the smoking of a cigarette and specifically, for having a cigarette in which the filtration is an integral function of the entire consumption process of the cigarette. By selecting the amount of filtration, the smoker can determine his/her own rate of withdrawal. Reduction of the tar content is the goal of most filters, however the combination of tar content and aeration gives the cigarette its taste. Too much or too little can have an adverse effect upon the whole process. Referring now to the figures by numerals of reference, and first to FIG. 1, 5 denotes generally to a cigarette that encompasses the filtration and aeration means of the present invention. The cigarette 5 generally comprises at one end a concentrically shaped cylindrical cigarette cord 6, having a lit end 16 and a mouth end 19, and at the other end integral with the cord 6 at the mouth end 19, a similarly shaped filter element 7. The filter element 7 is filled with a conventional filter material 14 which generally is a type of cellulose fiber.

The cigarette cord 6 includes three coaxial components, an outer cylindrical tube of shredded tobacco 10, a concentric filter rod 15 that is longitudinally and coaxially positioned within the tube of tobacco 10 and a concentrical air passage channel 8 that is coaxially deposed within the filter rod 15. The filter rod 15 is filled with one of the low density, porous filter mediums 13 which are readily available. FIG. 1 shows tags 11, which are interposed along the length of the filter rod 15, the tags 11 being high density filter disks. The tags 11 are generally circular in shape and also function to connect the filter rod 15 with the shredded tobacco 10. The shredded tobacco 10 is contained by a paper film of reconstituted tobacco products 17. The tags 11 will generally be of different diameters, with the larger diameter disks towards the mouth end 19 of the cigarette cord 5. Fresh air enters the cigarette cord 6, through an opening 9 in the air passage channel 8 and also through the porous filter rod 15, at the lit end 16. The entire cigarette cord 6 is covered with a porous paper wrapper 12 which allows additional fresh air to enter the cigarette 5. The tags 11, being of a denser material, serve to deflect fresh air through the tobacco 10. As the cigarette cord 6 burns down, the filtering medium 13 and the tags 11 (because they are combustible, frangible and friable) will fall off with the ash produced by the tobacco 10. The cigarette 5 therefore burns down very similar to a normal cigarette. One significant reduction will be that of residue towards the mouth 19 end of the cord 6. In standard cigarettes the amount of particulate matter in the last 20 percent is equal to the first 80 percent, that is because the tobacco 10 itself acts as a filter. The combination of tags 11 and the low density filter 13 will drastically reduce the particulate matter from being able to accumulate.

Figure 3:
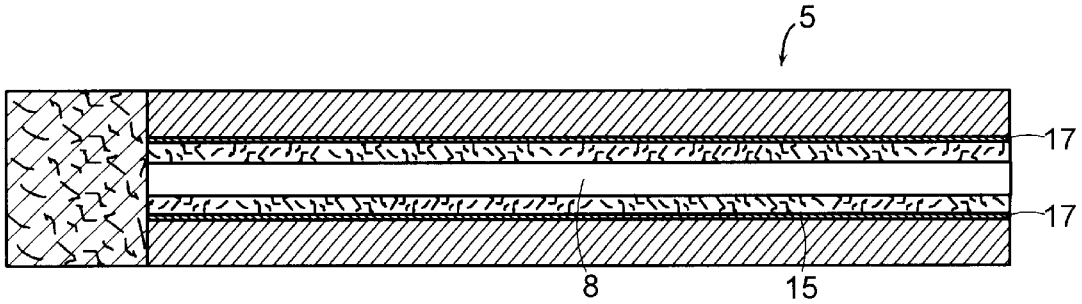
FIG. 3 is a longitudinal, cross-sectional view of the cigarette without tags.

Another embodiment is depicted in FIG. 3 whereby the tags 11 are not present, however the size of the fresh air passage channel 8 can be increased in ratio to the filtering material 13. The size of the rod itself can be increased which will basically decrease the amount of tobacco present for consumption. The filter material 13 in the rod 15 may be almost eliminated but filtration will still be present, because of the presence of the tags, for the entire consumption of the cigarette cord 6. The amount of fresh air, having been increased significantly, will give the smoker a different taste than with other embodiments, but still will provide more filtration than one would expect to get with conventional cigarettes. The increased air will reduce the temperature of the smoke vapor and consequently reduce the toxic content thereof. This reduction of toxicity is caused by the cool air intermingling with the smoke thus causing condensation. Since condensation is heavier than the smoke, it will cause particulate matter to drop from the smoke thus making it easier for the filters to entrap it.

Figure 4:
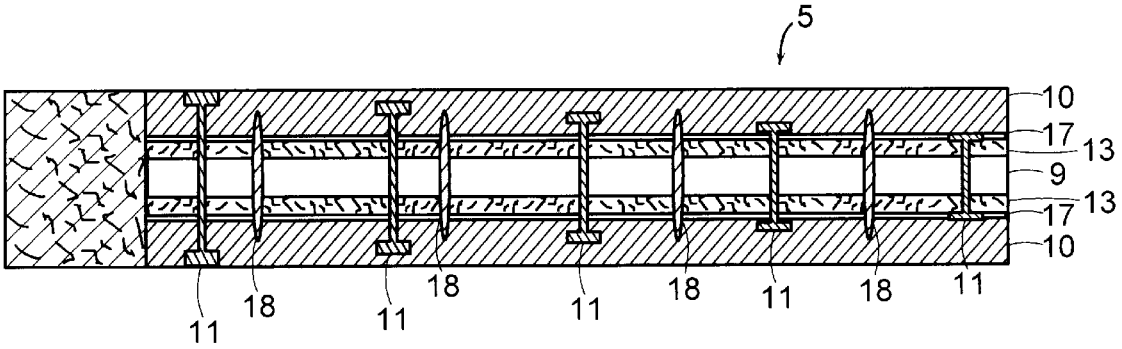
FIG. 4 is a longitudinal, cross-sectional view of the cigarette of FIG. 3 with increased filtration means in the form of rings.

Still another embodiment is shown by FIG. 4 whereby the cigarette of FIG. 3 has added additional filtration in form of one or more filter rings 18 which are high density filters evenly dispersed along the cigarette cord. These filter rings 18 are also combustible, frangible and friable and are spaced equally throughout the cigarette cord 6. This increased filtration will help reduce, in addition to the tars, the nicotine content because as previously stated the nicotine enters the smoker on droplets of tar. If you reduce the tar then you essentially reduce the nicotine. In all cigarettes, the tars give the cigarette its taste while the nicotine provides the addiction.

It is to be further understood that the present invention is not limited to the sole embodiment described above, but encompasses any and all embodiments within the scope of the claims.

I claim:

1. A coaxial filter cigarette comprising:

a cigarette cord having a cylindrical tube of shredded tobacco, the cord having a lit end and a mouth end, the tube of tobacco being supported by a film of reconstituted tobacco products, the cord being covered with a porous paper wrapper;

a concentric filter rod longitudinally and coaxially positioned within the cigarette cord, the rod filled with a low density porous filter fill and extending the entire length of the cord, the rod having a diameter smaller than the cord;

means defining a hollow air passage channel through the low density filter fill, coaxially disposed within and extending the length of the rod and having a smaller cross-sectional area than the rod, an open end defined at the lit end whereby fresh air enters the cigarette to dilute and cool the smoke stream as the cigarette is progressively consumed from the lit end in correspondence with the progress of a smoking process while the smoke flows through the cord and towards the mouth end, the cooling of the smoke vapor causing condensation whereby the particulate matter drops out from the smoke vapor.

2. The cigarette according to claim 1, wherein the cigarette further includes a filter element having a conventional filter fill, the filter element integrally connected at the mouth end of the cord.

3. The cigarette according to claim 1, wherein the diameter of the rod is varied to either increase or decrease the size of the cord of tobacco, thereby varying the strength of the smoke stream.

4. The cigarette according to claim 1, wherein the cigarette further includes one or more generally circular tags interposed along the length of the filter rod, the tags being high density filter disks interconnecting the rod with the tube of shredded tobacco.

5. The cigarette according to claim 4, wherein the tags are of varying diameters with the smaller diameter tags towards the lit end and progressively larger as they move towards the mouth end, the tags deflecting fresh air and smoke vapor thereby allowing for the greatest amount of filtration to be at the mouth end where the largest amount of particulate matter accumulates.

6. The cigarette according to claim 5, wherein the cigarette further includes one or more very high density circular filter rings evenly dispersed along the length of the rod, the rings increasing the quality of filtration by entrapping the droplets of tar which carry the nicotine in the smoke stream.

7. The cigarette according to claim 6, wherein all the elements of the cigarette cord being combustible, frangible and friable fall off with the tobacco ash as the cigarette is consumed.

8. A coaxial filter cigarette comprising:

a cigarette cord having a cylindrical tube of shredded tobacco, the cord having a lit end and a mouth end, the tube of tobacco being supportable by a film of reconstituted tobacco products, the cord being covered with a porous paper wrapper;

a concentric filter rod longitudinally and coaxially positioned within the cigarette cord, the rod filled with a low density porous filter fill and extending the entire length of the cord, the rod having a diameter smaller than the cigarette cord;

means defining a hollow air passage channel through the low density filter fill, coaxially disposed within and extending the length of the rod and having a smaller cross-sectional area than the rod, an opening defined at the lit end whereby fresh air may enter the cigarette thereby diluting and cooling the smoke stream as the cigarette is progressively consumed from the lit end in correspondence with the progress of a smoking process while the smoke flows through the cord and towards the mouth end, the cooling of the smoke stream causing condensation of particulate matter;

one or more generally circular tags interposed along the length of the filter rod, the tags being high density filter disks interconnecting the rod with the tube of shredded tobacco; while encirculing the hollow air passage channel; and one or more circular filter rings evenly dispersed perpendicularly along the rod to effectively increase filtration by entrapping the droplets of tar in the smoke stream thereby reducing the amount of nicotine reaching the smoker.

9. The cigarette according to claim 8, wherein the cigarette further includes a filter element having a conventional filter fill, the filter element integrally connected at the mouth end of the cord.

10. The cigarette according to claim 8, wherein the tags are of varying lengths with the smaller diameter tags towards the lit end and progresively larger as they move towards the mouth end, the tags deflecting fresh air and smoke vapor thereby allowing for the greatest amount of filtration to be at the mouth end where the amount of particulate matter accumulates.

11. The cigarette according to claim 8, wherein all the elements of the cigarette cord being combustible, frangible and friable fall off with the tobacco ash as the cigarette is consumed.

* * * * *